US005581620A

United States Patent [19]

Brandstein et al.

[11] Patent Number: 5,581,620

[45] Date of Patent: Dec. 3, 1996

[54] METHODS AND APPARATUS FOR ADAPTIVE BEAMFORMING

[75] Inventors: Michael S. Brandstein, Providence; Harvey F. Silverman, East Greenwich, both of R.I.

[73] Assignee: Brown University Research Foundation, Providence, R.I.

[21] Appl. No.: 231,646

[22] Filed: Apr. 21, 1994

[51] Int. Cl.[6] ..... H04R 3/00

[52] U.S. Cl. ..... 381/92; 367/125; 367/126

[58] Field of Search ..... 381/122, 92, 66, 381/26, 155; 367/125, 124, 126, 121, 123

[56] References Cited

U.S. PATENT DOCUMENTS

| | | | |
|---|---|---|---|
| 3,579,104 | 5/1971 | Pignard et al. | 367/125 |
| 3,787,849 | 1/1974 | Sletten et al. . | |
| 4,017,859 | 4/1977 | Medwin . | |
| 4,112,430 | 9/1978 | Ladstatter . | |
| 4,131,760 | 12/1978 | Christensen et al. | 381/66 |
| 4,333,170 | 6/1982 | Mathews et al. | 367/125 |
| 4,639,733 | 1/1987 | King et al. . | |
| 4,641,143 | 2/1987 | Apostolos . | |
| 4,651,155 | 3/1987 | Baurle et al. . | |
| 4,658,426 | 4/1987 | Chabries et al. . | |
| 4,723,292 | 2/1988 | Taguchi . | |
| 4,741,038 | 4/1988 | Elko et al. | 381/92 |
| 4,752,961 | 6/1988 | Kahn | 381/92 |
| 4,754,282 | 6/1988 | Edelbluate et al. . | |
| 4,769,847 | 9/1988 | Taguchi . | |
| 4,811,404 | 3/1989 | Vilmur et al. . | |
| 5,218,359 | 6/1993 | Minamisono . | |

FOREIGN PATENT DOCUMENTS

352537A1 2/1985 Germany .

OTHER PUBLICATIONS

Zibulski et al., "Oversampling in the Gabor Scheme," IEEE, Transaction Signal Processing pp. 281–284 (1992).

Flanagan et al., "Computer–Steered Microphone Arrays for Sound Transduction in Large Room," Journal Of Acoustical Socieity Of America, vol. 78, No. 5, pp. 1508–1518 (1985).

Greenberg et al., "Evaluation of an Adaptive Beamforming Method for Hearing Aids," Journal Of Acoustical Society Of America, vol. 91, No. 3, pp. 1662–1676 (1992).

Flanagan, "Bandwidth Design for Speech–Seeking Microphone Arrays," Proceedings Of 1985 ICASSP, pp. 732–735, (1985).

Kellermann, "A Self–Steering Digital Microphone Array," Proceedings Of 1991 ICASSP, pp. 3581–3584 (1991).

Yau et al., "Image Restoration by Complexity Regularization Via Dynamic Programming," IEEE, International Conference On Acoustic Speech, and Signal Processing, vol. 3, pp. 305–308 (1992).

(List continued on next page.)

*Primary Examiner*—Curtis Kuntz
*Assistant Examiner*—Vivian W. Chang
*Attorney, Agent, or Firm*—Thomas J. Engellenner; Lahive & Cockfield

[57] ABSTRACT

Methods and systems for beamforming are disclosed that include a signal processor that can dynamically determine the relative time delays between a plurality of frequency-dependent signals. The signal processor can adaptively generate a beam signal by aligning the plural frequency-dependent signals according to the relative time delays between the signals. The signal processor can store one frequency-dependent signal as a reference signal and can align the remaining frequency-dependent signals relative to this reference signal. One advantage of the signal processor is that it can align the plural frequency-dependent signals generated by an array of microphones that can be arranged in a linear, two dimensional or three dimensional array and located in a room environment.

25 Claims, 6 Drawing Sheets

OTHER PUBLICATIONS

Silverman et al., "A Two-Stage Algorithm for Determining Talker Location From Linear Microphone Array Data," Computer Speech And Language, vol. 6, pp. 129–152 (1992).

Piersol, "Time Delay Estimation Using Phase Data," IEEE Transactions On Acoustics, Speech, And Signal Processing, vol. ASSP–29, No. 3, pp. 471–477 (1981).

Chan et al., "The Least Squares Estimation on Time Delay and Its Use in Signal Detection," IEEE Transactions On Acoustics, Speech, And Signal Processing, vol. ASSP–26, No. 3, pp. 217–222 (1978).

IEEE, International Conference On Acoustics, Speech And Signal Processing, p. 320, (1976).

IEEE International Conference On Acoustics, Speech And Signal Processing, vols. 3 of 4, p. 1699 (1987).

METHODS AND APPARATUS FOR ADAPTIVE BEAMFORMING

This invention was made with government support under Grant/Contract No. MIP-9120843 awarded by the National Science Foundation. The government has certain rights in this invention.

FIELD OF THE INVENTION

The present invention relates to methods and apparatus for adaptive signal processing and, more particularly, to methods and apparatus for adaptively combining a plurality of signals, e.g., electrically represented audio signals, to form a beam signal.

BACKGROUND OF THE INVENTION

Many communication systems, such as radar systems, sonar systems and microphone arrays, use beamforming to enhance the reception of signals. In contrast to conventional communication systems that do not discriminate between signals based on the position of the signal source, beamforming systems are characterized by the capability of enhancing the reception of signals generated from sources at specific locations relative to the system.

Generally, beamforming systems include an array of spatially distributed sensor elements, such as antennas, sonar phones or microphones, and a data processing system for combining signals detected by the array. The data processor combines the signals to enhance the reception of signals from sources located at select locations relative to the sensor elements. Essentially, the data processor "aims" the sensor array in the direction of the signal source. For example, a linear microphone array uses two or more microphones to pick up the voice of a talker. Because one microphone is closer to the talker than the other microphone, there is a slight time delay between the two microphones. The data processor adds a time delay to the nearest microphone to coordinate these two microphones. By compensating for this time delay, the beamforming system enhances the reception of signals from the direction of the talker, and essentially aims the microphones at the talker.

A major factor in the effectiveness of these beamforming systems is the accuracy of the time delays necessary for aiming the sensor array. One known technique for determining the time delays necessary for aiming the sensor array employs a priori knowledge of the source position, the source orientation and the radiation pattern of the signal. Essentially, the data processor determines from the position of the source and, from the position of the sensor elements, a delay factor for each of the sensor elements. The data processor then applies such delay factors to the respective sensor elements to aim the sensor array in the direction of the signal source.

Although these systems work well if the position of the signal source is precisely known, the effectiveness of these systems drops off dramatically with slight errors in the estimated a priori information. For instance, in some systems with source-location schemes, it has been shown that the data processor must know the location of the source within a few centimeters to enhance the reception of signals. Therefore, these systems require precise knowledge of the position of the source, and precise knowledge of the position of the sensors. As a consequence, these systems require both that the sensor elements in the array have a known and static spatial distribution and that the signal source remains stationary relative to the sensor array. Furthermore, these beamforming systems require a first step for determining the talker position and a second step for aiming the sensor array based on the expected position of the talker.

Other techniques for determining the direction for aiming the sensor array rely on a priori information regarding the signal waveform and the signal radiation pattern. For example, radar systems use beamforming to transmit signals in a select direction. If an object is present in that direction, the signal reflects off the object and travels back toward the radar system. Therefore, the radar system is transmitting and receiving very similar signals. Furthermore, the data processor assumes that the objects are sufficiently distant from the sensor array that the incoming signals have a particular radiation pattern. The assumed radiation pattern can be a particularly simple pattern that reduces the complexity of the time delay computation.

The radar system capitalizes on the similarity of the transmitted and received signals by using signals that have features which facilitate signal processing. The data processor can directly compare the features of the received signal against the features of the transmitted signal and determine differences between the two signals that relate to the relative time delays between each sensor. Furthermore, the radar system can use the assumptions regarding the radiation pattern of the incoming signals to simplify the signal processing techniques necessary to calculate the time delays. The data processor then compensates for the respective time delays between each sensor element to aim the sensor array in the direction of the object.

Although these systems work well if the signal waveform is known, these systems less effective where the a priori information regarding the signal waveform is unavailable or insufficient to allow the received signals to be compared against a known signal waveform. Therefore, these systems are generally limited to active systems that both transmit and receive signals. Furthermore, these systems are less effective when assumptions regarding the radiation pattern cannot be made. Therefore, these systems are usually limited to those applications where the signal source is sufficiently distant from the sensor array that a signal pattern can be assumed.

A known technique for determining the direction of incoming signals without a priori information employs correlation strategies that compare signals received by the array at spatially distinct sensors to estimate the time delays between the sensors. The time delay information, along with assumptions about the radiation pattern, are used to estimate the location of the signal source. One example of correlation strategies for locating talker position with a microphone array in a near-field environment is set forth in Silverman et al., *A Two-Stage Algorithm for Determining Talker Location from Linear Microphone Array Data,* Computer Speech and Language, at 129–152 (1992). In general, the cross-correlation function of two signals received at two distinct sensors is computed and filtered in some optimal sense. The data processor includes a peak detector that detects the maximum value of the filtered signal. While the filtering criteria and the methods used for peak detection may vary considerably, these techniques are all based on maximizing the correlation between two received signals and determining from the detected peak the relative time delays between the associated sensors. Once the time delays are determined, techniques, such as triangulation, can be used to determine the location of the signal source.

Although these systems can work well, there is generally a trade-off between the accuracy of the time delay estimate and the computational expense incurred by the procedure. Furthermore, there can be a tradeoff between the accuracy of the delay estimate and the rate at which the system can acquire the incoming signals. The cross-correlation function is a computationally intensive operation, and the accuracy of the peak data increases with the number of comparisons made during the correlation. In order to achieve a peak that is sufficiently accurate and well defined to identify precisely the position of the source, the computational burden can be prohibitive. Therefore, these systems can fail to produce the desired accuracy and update rate required for effective beamforming in a real-time environment.

In view of the foregoing, an object of the present invention is to provide improved signal processing methods and systems for combining a plurality of signals, and more particularly, to provide improved systems and methods for beamforming that dynamically determine the time delay estimates for a sensor array as part of the beamforming process.

A further object of the present invention is to provide systems and methods for real-time beamforming without the need of a priori information about the position of the signal source or knowledge of the signal radiation pattern.

Another object of the present invention is to provide signal processing systems and methods for adaptively aiming an array of sensor elements at a moving signal source.

A yet further object of the present invention is to provide signal processing systems and methods that can dynamically compensate for a sensor array that has a non-uniform or unknown spatial distribution of sensors.

A still further object of the present invention is to provide systems and methods for real-time beamforming without the need of a priori information about the signal waveform.

Still another object of the present invention is to provide computationally efficient systems and methods to determine the relative time delays between the signals received by the sensor elements of a sensor array and employ these delay estimates for computationally efficient beamforming and source location.

These and other objects of the invention are evident in the sections that follow.

SUMMARY OF THE INVENTION

The aforementioned objects are obtained by the present invention which provides in one aspect an adaptive beamforming apparatus which operates to combine a plurality of frequency-dependent signals to enhance the reception of signals from a signal source located at a select location relative to the apparatus.

In one embodiment, the beamforming apparatus connects to an array of sensors, e.g. microphones, that can detect signals generated from a signal source, such as the voice of a talker. The sensors can be spatially distributed in a linear, a two-dimensional array or a three-dimensional array, with a uniform or non-uniform spacing between sensors. In a typical practice, the sensor array can be mounted on a wall or a podium and the talker is free to move relative to the sensor array. Each sensor detects the voice audio signals of the talker and generates electrical response signals that represent these audio signals. The adaptive beamforming apparatus provides a signal processor that can dynamically determine the relative time delay between each of the audio signals detected by the sensors. Further, the signal processor includes a phase alignment element that uses the time delays to align the frequency components of the audio signals. The signal processor has a summation element that adds together the aligned audio signals to increase the quality of the desired audio source while simultaneously attenuating sources having different delays relative to the sensor array. Because the relative time delays for a signal relate to the position of the signal source relative to the sensor array, the beamforming apparatus provides, in one aspect, a system that "aims" the sensor array at the talker to enhance the reception of signals generated at the location of the talker and to diminish the energy of signals generated at locations different from that of the desired talker's location.

A beamforming apparatus constructed according to the present invention can include a signal processor that determines the relative time delay between a plurality of frequency-dependent signals. The signal processor can store one frequency-dependent signal as a reference signal and can align the remaining frequency-dependent signals relative to this reference signal. The reference channel can include a memory for storing one of the frequency dependent signals as a reference signal having a user selected phase angle. The reference channel can connect to a plurality of alignment channels, where each alignment channel couples to a respective one of the frequency-dependent signals. The alignment channels can operate to adjust the phase angle of each of the frequency-dependent signals in order to align the signals relative to the reference signal. Each alignment channel can have a phase difference estimator that generates a delay signal which represents the time delay between the reference signal and the respective signal connected to the alignment channel. The alignment channel can also include a phase alignment element that generates an output signal as a function of the delay signal, which has a magnitude that represents the magnitude of the respective signal and a phase angle that is adjusted into a select phase relationship with the reference signal. The signal processor can further include a summation element that couples to the alignment channels and to the reference channel. The summation element can generate a beam signal by summing the output signals with the reference signal.

The adaptive beamforming apparatus can include an array of spatially distributed sensor elements for generating the plurality of frequency-dependent signals. The sensor elements can be any one of a number of different types of elements capable of detecting a signal. Examples of such sensor elements include antennas, microphones, sonar transducers and various other transducers capable of detecting a propagating signal and transmitting the signal to the signal processor.

The sensor elements are spatially distributed to form an array for detecting a signal. Each sensor in the array can generate a single signal that represents the signal detected at that sensor element as a function of time. The spatial distribution of sensor elements can be unknown or non-uniform. The invention can be practiced with a linear array, a two dimensional array, or a three dimensional array.

In one embodiment of the invention, the reference channel of the signal processor can connect to the phase difference estimator of each alignment channel. In this practice, the phase difference estimator includes a memory for storing the reference signal and for storing the respective frequency-dependent signal associated with the respective alignment channel. The phase difference estimator has a processing means to generate the delay signal as a function of the reference signal and the respective frequency-dependent signal.

In an alternative embodiment, the signal processor can include interconnected alignment channels that determine the relative time delay between spatially adjacent sensors. In this practice, the phase difference estimator can include a memory for storing the respective frequency-dependent signal of the associated alignment channel and the respective frequency-dependent signal of the second alignment channel. The memory can further store the delay signal of the second alignment channel. The phase difference estimator can include a summing element that generates a delay signal as a function of the signal associated with the respective alignment channel and delay signal of the second alignment channel.

In an alternative embodiment of the invention the signal processor can include a weighting element, that can increase or decrease the magnitude component of selected output signals. The weighting element can be a weighted averaging element that can affect the magnitudes of the output as a function of the number of output signals summed together.

In a further alternative embodiment of the present invention, an error detector is associated with each of the delay estimators and determines from the delay signals and the frequency-dependent signals, an error signal that represents the accuracy of the delay signals. The error signal can be used by the weighted averaging element to determine which of the output signals has an associated error signal that is larger than a user-selected error parameter. The summation means can effect the weighting of that output signal responsive to the error signal, including deleting that output signal from the signal summation.

In another further embodiment of the invention, the delay estimator generates a delay signal that represents the time delay between a reference signal and a respective one of the frequency dependent signals, by measuring the difference between the phase angle components to the frequency-dependent signals. In one embodiment the delay estimator measures the difference in phase angles between the reference signal and the respective frequency-dependent signal of that alignment channel. The delay estimator can calculate from the differences in phase angles and from the frequency associated with each phase angles, the relative phase shift between the two signals. In one embodiment of the invention, the delay estimator can further include a weighting system that multiplies the difference in phase angles of each frequency component of two respective signals, by the magnitude of that frequency component.

BRIEF DESCRIPTION OF THE DRAWINGS

The foregoing and other aspects of the invention may be more fully understood from the following description, when read together with the accompanying drawings in which like reference number indicate like parts in the several figures, and in which.

DETAILED DESCRIPTION

Figure 1:
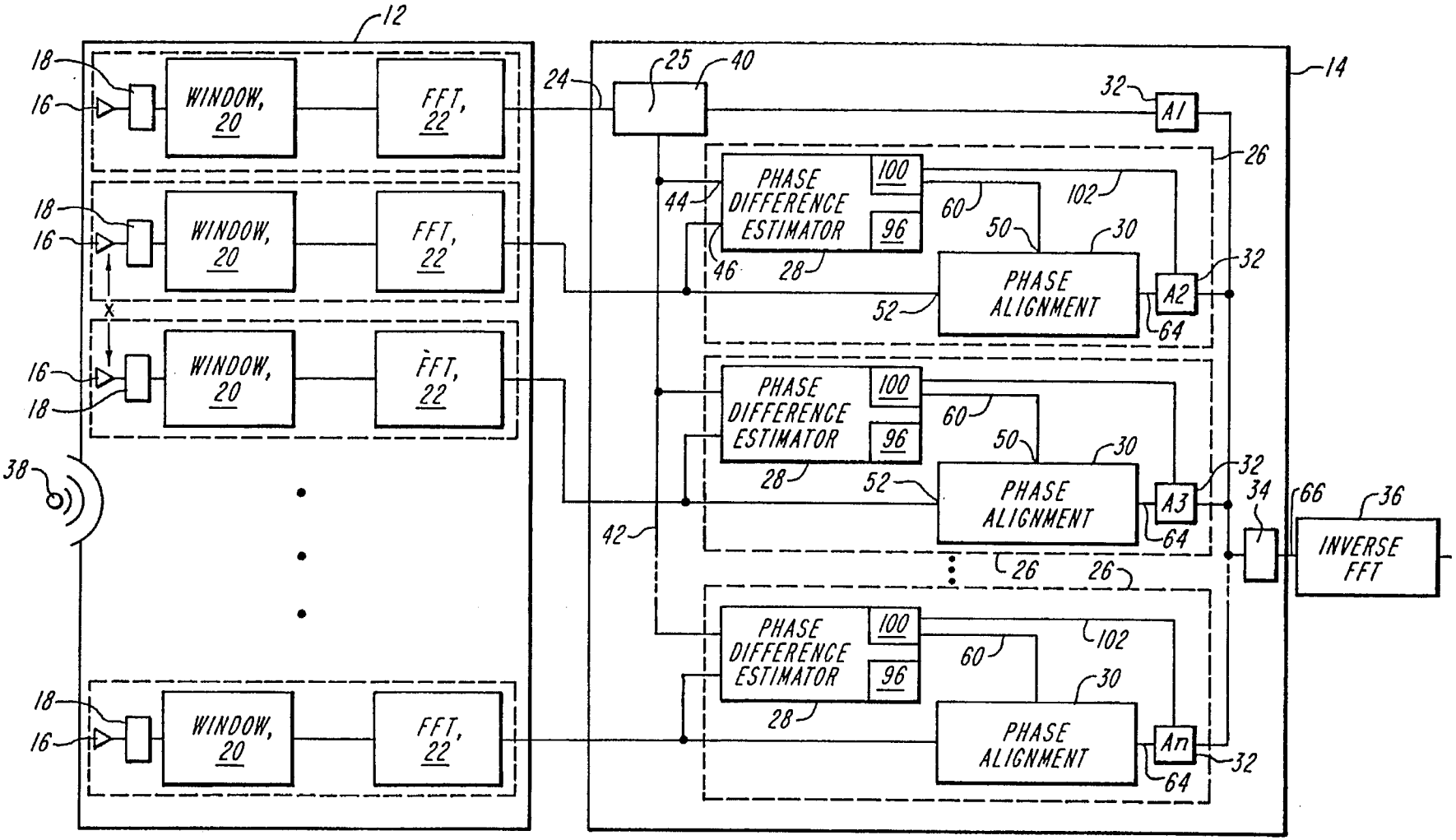
FIG. 1 illustrates a schematic block diagram of one embodiment of a beamforming apparatus constructed according to the present invention.

FIG. 1 depicts an adaptive beamforming apparatus 10 constructed in accord with the invention. The illustrated apparatus 10 includes a sensor array 12 and a signal processor 14. The sensor array 12 includes the sensors 16, sampling units 18, window filters 20 and time-to-frequency transform elements 22. The signal processor 14 includes a reference channel 24 and plural alignment channels 26. Each alignment channel 26 includes a phase difference estimator 28, phase alignment element 30 and an optional weighting element 32. The illustrated system 10 further includes a summation element 34 and a frequency-to-time transform element 36.

The illustrated sensor array 12 includes a plurality of sensor elements 16. The sensors 16, in the depicted embodiment, are arranged to form a spatially distributed linear array of sensors 16 each spaced apart by a distance X and arranged to receive input signals having signal components from a signal source, such as the target source 38. In the illustrated embodiment, each sensor 16 is the front end of an reception channel that includes a sampling unit 18, a window filter 20 and a time-to-frequency transform element 22 all connected in electrical circuit. Each of the illustrated reception channels is a distinct subsystem of the sensor array 12 and can operate simultaneously with and independently from the other reception channels.

Each sensor 16 detects signals, including signals generated from the target source 38, and generates an electrical response signal that includes a component that represents the signal generated frown the signal source 38. The sensors 16 in the sensor array 12 can be microphones, antennas, sonar phones or any other sensor capable of detecting a signal propagating from the source 38 and generating an electrical response signal that represents the detected signal.

Each illustrated sampling element 18 is in electrical circuit with one sensor 16 and generates a digital response signal by sampling the electrical response signal generated by the associated sensor 16. The sampling element 18 can be a conventional analog-to-digital converter circuit of the type commonly used to sample analog electrical signals and generate digital electrical signals that represent the sampled signal. The sampling element 18 generates samples of the electrical response signal at a rate, $f_{rate}$, selected according to the application of the beamforming apparatus 10. The sampling rate is generally determined according to the highest frequency component of the propagating signal of interest and according to the Nyquist rate. The sampling elements 18 are discussed in further detail below.

The window filter 20 can be a conventional digital window filter for selecting a discrete portion of a digital response signal. In the illustrated embodiment the window filter 20 is in electrical circuit with the output of the sampling element 18, and generates a finite length digital signal by truncating the digital signal generated by the sampling unit 18. In one embodiment, the window filter 20 can be a rectangular window filter that truncates the digital signal to a user-selected number of samples to represent the input signal detected by sensor 16. Each discrete portion of the sampled signal is a frame of data that corresponds to the signal detected by the sensor 16 during a time period determined by the sampling rate and the number of samples present in the frame. The window filter 20 is discussed in further detail below.

In the depicted apparatus 10, the window filters 20 are in electrical circuit with the time-to-frequency transform elements 22. Each time-to-frequency transform element 22 can receive the data frames generated by filter 20 and transform each data frame into a frequency-dependent signal that represents the spectral content of the signal detected by the associated sensor 16 during the time period of the corresponding data frame. Each frequency-dependent signal can include a magnitude component, |R|, and a phase angle component, $\phi$, for each frequency, $\omega n$, in the spectral content of the transformed data frame. In one embodiment of the present invention, the frequency-dependent signals are stored in the apparatus 10 as complex arrays. Each complex array can include a storage cell that corresponds to a predetermined frequency, $\omega_n$, and therefore can store the spectral contents of a data frame by filling the appropriate cell with the magnitude and phase angle of the corresponding frequency component in the spectral content of the data frame. For example:

| | | | |
|---|---|---|---|
| \|R\| | wo | $\phi$ | wo |
| | w1 | | w1 |
| | w2 | | w2 |
| | w3 | | w3 |
| | w4 | | w4 |
| | wn | | wn |

can be a complex array that represents the spectral content of one frame of data, and has a first array, |R|, that represents the magnitude component of each frequency, $\omega_n$, and has a second array, $\phi$, that represents the phase angle component of each frequency, $\omega_n$. Other methods of storing or representing frequency-dependent signals should be apparent to one of ordinary skill in the art of signal processing and do not depart for the scope of the invention.

Therefore, the sensor array 12 generates from the target source 38 a plurality of frequency dependent signals, wherein each frequency-dependent signal is associated with one sensor 16, and represents the signal generated by target source 38, as "heard", by the associated sensor 16. The time-to-frequency transform element 22 can be any of the commonly known signal processing techniques for efficiently computing the discrete fourier transform of a time domain signal. In a preferred embodiment of the invention the time-to-frequency transform element 22 is a Fast Fourier Transform element that performs the discrete fourier transform on the window input signal generated by filter 20. It should be apparent to anyone of ordinary skill in the art of signal processing, that any efficient algorithm for transforming the input signal from the time domain to the frequency-domain can be practiced with the illustrated system, without the parting from the scope of the present invention.

The signal processor 14, constructed according to the invention, combines the input signals detected by the sensor array 12 and essentially "aims" the sensor array 12 at a signal source, e.g. source 38. The processor 14 "aims" the array 12 by generating a beam signal 66 that represents a combination of phase aligned input signals. The beam signal 66 enhances, i.e. increases the signal-to-noise ratio, of signals generated from a source at the position of target source 38 relative to the sensor array 12.

The signal processor 14 has a reference channel 24, plural alignment channels 26 and a summation element 34. The reference channel 24 connects to one input channel and stores the frequency-dependent signal associated with that input channel in the memory element 40 as a reference signal 25. The phase angle components of the reference signal can be defined as in-phase relative to the phase angle components of the other frequency-dependent signals. Each alignment channel 26 generates an output signal 64 representing the signal received at the associated sensor 16 phase aligned relative to the reference signal 25. The phase aligned signals are combined to form the beam signal 66.

The illustrated signal processor 14 is in electrical circuit with the sensor array 12 and receives the frequency-dependent signals generated by the time-to-frequency elements 22. The signal processor 14, depicted in FIG. 1, is represented as circuit assemblies connected in electrical circuit. It should be apparent to one of ordinary skill in the art of signal processing that each circuit assembly depicted in FIG. 1 can be implemented as a software module and that the software modules can be similarly interconnected in a computer program to implement the signal processor 14 as an application program running on a conventional digital computer.

The illustrated signal processor 14 includes a plurality of channels each connected to a respective one of the frequency-dependent signals. In the illustrated embodiment, the signal processor 14 includes a reference channel 24 and a plurality of alignment channels 26. The reference channel 24 has a storage element 40 for storing the reference signal 25 that represent the input signal detected by one of the sensors 16. The memory 40 can store the reference signal 25 as a complex array. The storage element 40 is in electrical circuit via the conducting element 42 to each of the alignment channels 26. The conducting element 42 connects to each of the phase difference estimators 28 in the alignment channels 26. The phase difference estimator 28 of each of the alignment channels 26 has a second input 46 that is in electrical circuit with the output of a time-to-frequency transform element 22.

With reference to FIG. 1 it can be seen that the alignment channels 26 of the illustrated signal processor 14 each connect to one time-to-frequency transform element 22. The phase difference estimator 28 of each alignment channel 26 generates a delay signal 60 which approximates the time delay between the signal 25 detected by the sensor 16 associated with the reference channel 24 and the signal detected by the sensor 16 associated with alignment channel of the phase difference estimator 28. This estimated delay signal 60 can be generated by any of the conventional time delay estimation techniques. These techniques can include cross-correlation algorithms with peak picking or frequency based delay estimators, including one preferred frequency based delay estimator that will described in greater hereinafter. For those delay estimators that include correlation techniques that operate in the time-domain, the phase difference estimator can include a frequency-to-time transform element to convert the magnitude and phase angle data of a data frame into a time dependent signal. A frequency-to-time transform element suitable for practice with the present innovation will be explained in greater detail herein after. However, any conventional domain transform algorithm or system can be practiced with the present invention without departing form the scope of the invention and such domain transform elements are considered within the ken of one of ordinary skill in the art of signal processing.

As further depicted by FIG. 1, each alignment channel 26 of the signal processor 14 includes a phase alignment element 30 that connects in electrical circuit via the conducting element 48 to the output of the phase difference estimator 28. The conducting element 48 carries the delay signal 60 to the first input 50 of phase alignment element 30. A second input 52 of phase alignment element 30 connects to the respective frequency-dependent signal of the respective input channel. As will be explained in greater detail hereinafter, the phase alignment element 30 can generate an output signal that is phase-aligned to the reference signal 25 stored in storage element 40.

The output signals 64 of the depicted signal processor 14 are applied to optional weighting elements 32. The weighting element 32 can increase or decrease the magnitude of the output signal. Each of the weighting elements 32 generate a weighted output signal that connects to the summation element 34. The summation element 34 can sum together the weighted and phased aligned signals of each alignment channel and the weighted reference signal 25 of the reference channel 24. The summation element 34 generates a beam signal 66. The beam signal 66 represents a combination of phase aligned input signals that enhances, i.e. increases the gain, of signals generated from a source at the position of target source 38 relative to the sensor array 12.

Figure 2:
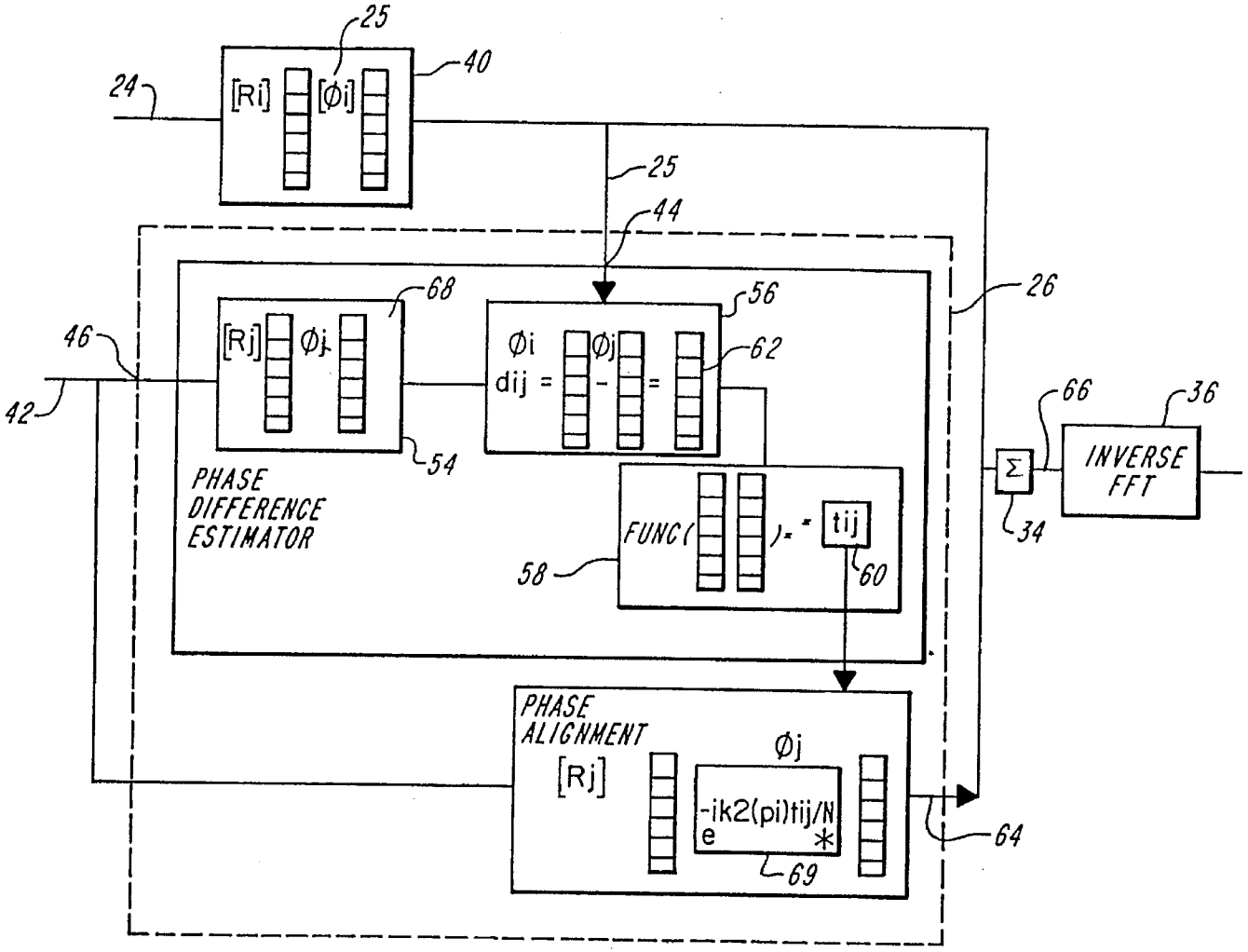
FIG. 2 illustrates a schematic block diagram of one alignment channel of the beamforming apparatus depicted in FIG. 1.

With reference to FIG. 2, the construction and operation of a signal processor 14 constructed according to the embodiment shown in FIG. 1 can be described. FIG. 2 illustrates the reference channel 24, the memory element 40, a phase alignment channel 26, that includes a phase difference estimator 28 and a phase alignment element 30. The phase alignment element 30 and the memory element 40 are in electrical circuit to the summing element 34 that generates a signal transmitted over a conducting wire to the frequency-to-time transform element 36. In the illustrated embodiment, the alignment channel 26, including the phase difference estimator 28 and the phase alignment element 30, aligns the frequency-dependent signal 68, transmitted via conducting element 42, to the reference signal 25, stored in the data memory 40.

In a first step, the phase difference estimator 28, generates the delay signal 60 that represents the time delay between the reference signal 25 and the frequency-dependent signal 68. In a second step, the phase alignment element 30, calculates, for each frequency component of the frequency-dependent signal 68, the phase shift:

k2(pi)tij/N for that frequency component caused by the time delay. The phase alignment element 30 can align each frequency component of signal 68 as a function of the delay signal 60, $t_{ij}$, and the frequency, 2(pi)k/N, where N can be the FFT size, and k can represent the frequency component, via the addition of the corresponding shift as given in the formula above, to the phase angle of the frequency-dependent signal 68. The phase alignment element 30 generates the output signal 64, that is aligned to the reference signal 25, and that can be represented as a complex array, including a magnitude component and a phase angle component. In a final step, the aligned signal 68 and the reference signal 25 are combined by the summing element 34 to generate the beam signal 66.

The phase difference estimator 28 illustrated in FIG. 2 includes the data memory 54, a phase angle subtractor 56 and a delay estimator 58. The illustrated phase difference estimator 28 is a frequency-domain phase difference estimator that generates the delay signal 60 that represents the relative time delay between the reference signal 25 stored in data memory 40 and the signal 68 stored the data memory 54. The illustrated data memory 54 provides storage for a complex array having a magnitude component RJ and phase angle component ΦJ. The data memory 54 is in electrical circuit with the phase angle subtractor 56 that includes a data memory for storing the phase angle component, ΦI, of the reference signal 25 and for storing the phase angle component, ΦJ, of the signal 68 stored in data memory 54. The phase angle subtractor 56 generates a signal 62 that represents the differences between the phase angles of the reference signal 25 and the phase angles of the respective frequency-dependent signal associated with that alignment channel 26. The signal 62 can represent the phase angle difference as an array that has cells indexed by frequency. The difference signal 62 can be transmitted over a conducting element to the delay estimator 58. In the illustrated embodiment the delay estimator 58, which will be explained in greater detail hereinafter, generates the delay signal 60 as a function of the phase angle difference signal 62.

The delay signal 60 connects via a conducting element to the phase alignment element 30. As illustrated by FIG. 2, the phase alignment element 30 is in electrical circuit with conducting element 42 to receive the frequency-dependent signal 68 associated with the alignment channel 26. The phase alignment element 30 can include a phase shift element 69 that can generate a shift signal representative of the phase shifts for each of the frequency components of the signal 68. The phase alignment element 30 can increment the phase angle ΦJ of the associated frequency-dependent signal by the shift signal. In one embodiment of the present invention, the phase alignment element 30 can be a programmable arithmetic-logic-unit that multiplies the phase angle of the associated frequency-dependent signal with the corresponding phase shift signal. However, it should be obvious to one of ordinary skill in the art of signal processing that the phase alignment element 30 can be implemented as a software module that includes programming structure for multiplying the phase angles of the signal 68 by the corresponding phase shift signals.

As further illustrated by FIG. 2, the output signal 64 is transmitted via a conducting element to the summation element 34 along with the reference signal 25 stored in data memory 40. The summation element 34 generates a beam signal 66 that represents the summation of the aligned output signals 64 from each of the alignment channels 26 in the signal processor 14 and the reference signal 25 stored in data memory 40. The illustrated signal processor of FIG. 2 includes an optional frequency-to-time transform 36 element that generates a time-dependent signal that represents the beam signal 66. In the illustrated embodiment the frequency-to-time domain transform element 36 is a inverse FFT of the type conventionally used to transform discrete signals from the time-domain to the frequency-domain.

Figure 3:
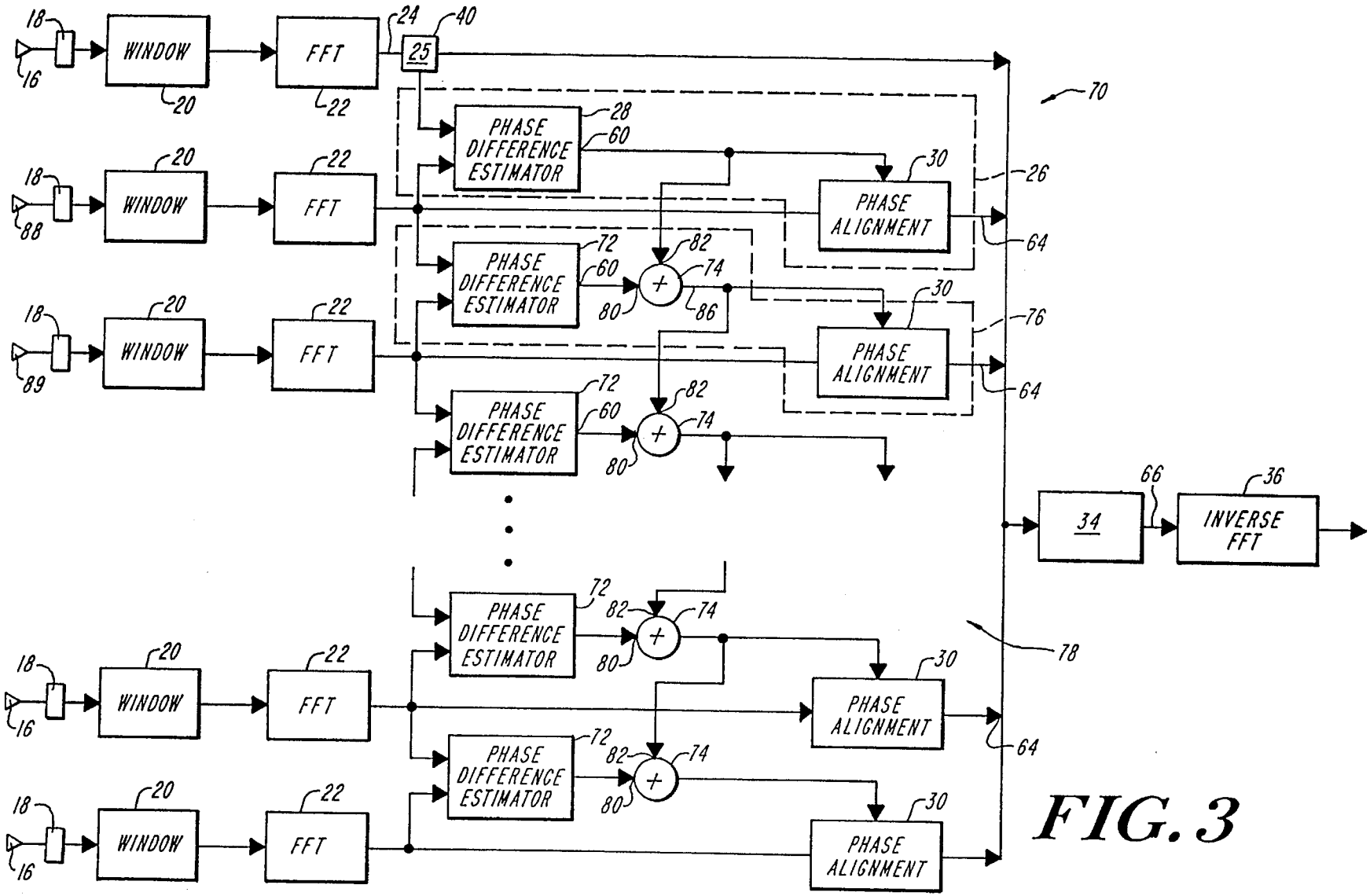
FIG. 3 illustrates an alternative embodiment of a beamforming apparatus constructed according to the present invention that includes phase difference estimators connected between spatially adjacent sensor elements.

With reference to FIG. 3, one preferred embodiment of the present invention can be described. FIG. 3 depicts a beamforming apparatus 70 connected to a sensor array 12 and a signal processor 78. The signal processor 78 includes a reference channel 24 that provides a data storage element 40 for storing one frequency-dependent signal associated with one of the sensors 16 as a reference signal 25 that includes a magnitude component and a phase angle component. The phase angle component of the reference signal 25 stored in the data memory 40 includes a phase angle corresponding to each one of the frequency components of the input signal detected by the sensor 16 associated with the reference channel 24. The phase angles of the reference signal 25 can represent a reference phase for that frequency component of the signal generated by the source 38. The storage element 40 generates an output signal that connects via a conducting element to the phase difference estimator 28 of the first alignment channel 26. As can be seen with reference to FIG. 3, the alignment channel 26 includes a phase difference estimator 28 and phase alignment element 30 constructed similarly to the previously described embodiment. The system 70 further includes a plurality of alignment channels 76 that include a phase difference estimator 72, a summing element 74, and a phase alignment element 30. The alignment channels 76 connect between two input channels of the sensor array 12. In the illustrated embodiment the alignment channels 76 preferably connect to spatially adjacent sensors in the sensor array 12.

In the illustrated embodiment of FIG. 3, the phase difference estimator 72 of each alignment channel 76 connects via conducting elements to the input channels of two spatially adjacent sensor elements to generate a delay signal 60 that represents the time delay between these two spatially adjacent sensors 16. The alignment channel 76 further includes a summing element 74. The summing element 74 has a first input 80 that connects via a conducting element to the output of the phase difference estimator 72. The summing element 74 has a second input 82 that connects via a conducting element to the delay signal of a phase difference estimator associated with a sensor 16 that is spatially adjacent. The summing element 74 generates an output signal that is connected via a conducting element to the phase alignment element 30.

As can be described with reference to FIG. 3, the alignment channel 26 calculates the time delay between the reference signal 25 and the frequency-dependent signal generated by the spatially adjacent sensor 88. A second alignment channel 76 calculates the time delay between the sensor 88 and the sensor 89. The summing element 74 of the alignment channel 76 connects between the channel 26 and the channel 76 and can add together the two time delays to generate a cumulative delay signal 86. The cumulative delay signal 86 represents the time delay between the sensor 16 of the reference channel 24 and the sensor 89 of the associated alignment channel 76. As illustrated, each summing element 74 of each alignment channel 76 adds the cumulative delay signal 86 to the delay signal 60 generated by the phase difference estimator 72. Therefore, the cumulative delay signal 86 references the each alignment channel 76 to the reference channel 24.

The cumulative signal 86 generated by the summing element 74 represents the summed time delay between the reference signal 25 stored in data memory 40 and the frequency-dependent signal associated with the alignment channel 76. The phase alignment 30 phase shifts the associated frequency-dependent signal by the total time delay represented by the signal 86 of summing element 74. The phase shift added to each frequency component of the associated frequency-dependent signal aligns the associated frequency-dependent signal to the reference signal 25 stored in data memory 40. The phase alignment element 30 generates an output signal 64 representative of the associated frequency-dependent signal phase aligned with the reference signal 25 stored in data memory 40. The output signal of phase alignment element 30 is transmitted via a conducting element to the summing element 34. As previously described, the summing element 34 sums the output signals generated by the alignment channels 26 and 76 with the reference signal stored in data memory 40. The combined signals represents a beam signal 66 that can be transmitted by a conducting element to the optional frequency-to-time transform means 36. The optional frequency-to-time transform element 36 can provide a output signal that represents the beam signal 66 as a time dependent signal.

The invention will now be further described with reference to one preferred embodiment that includes a frequency-domain delay estimator 58 and a linear array of microphones 16. The frequency-domain delay estimator 58 aims the sensor array 12 by dynamically determining the time delay between two frequency-dependent signals to maximize the power in the beam signal 66 formed by the summation of the frequency-dependent signals. A signal processor 14 with this preferred frequency-domain delay estimator 58 is shown to be accurate over a wide range of signal-to-noise conditions and an effective basis for more complex acoustic-array applications, such as source detection and tracking procedures. Further, it is suitable for determining the time delay between wide-band frequency-dependent signals, where there is limited a priori knowledge of the spectral content of the signals.

The sensor array 12 includes a linear array of eight microphone sensors 16 distributed at 16.5 cm intervals along one wall of a room. The input signals detected by the microphones 16 are digitized simultaneously at 20 kHz by sampling units 18 of eight distinct input channels. The 20 kHz sampled input signals are windowed by window filter elements 20 into finite sequences. For each sequence the DFT is computed by the associated time-to-frequency transform element 22 and converted to a magnitude-phase representation. The choice of the window filter 20 and the size as well as the DFT length vary with the particular application and computational availability. One preferred window filter 20 is a 512-point Hanning window applied with zero padding for use with a 1024-point FFT as a time to frequency transform element 22. The individual segments can be half-overlapping in time to facilitate reconstruction.

For each pair of spatially consecutive microphones 16, the phase angle subtractor 56 calculates the phase angle differences between corresponding frequencies and generates the signal 62, $d_{ij}(k)$ . Each frequency component of the frequency-dependent signals can be represented by:

$$\Omega = \frac{2\pi k}{N}$$

where N is the DFT length, k=0, 1, . . . , N- 1, and $\Omega$ is angular frequency. R(k) represents the spectral magnitude component of the frequency dependent signal. A phase delay signal 60, $\tau_{ij}$, is then computed according to the function:

$$\tau_{ij} = \frac{\sum_{k=0}^{K} |R(k)|^2 \left(\frac{2\pi k}{N}\right) d_{ij}(k)}{\sum_{k=0}^{K} |R(k)|^2 \left(\frac{2\pi k}{N}\right)^2}$$

where R(k) can represent, in one embodiment, the geometric mean of the magnitude components of the frequency-dependent signals, $R_i$, $R_j$. It should be obvious to one of ordinary skill in the art of signal processing that values for R(k) can be computed in using other statistical techniques, including determining the median of plural signals, weighted averaging and other techniques that can improve signal-to-noise rejection and error estimate.

The frequency-domain delay estimator 28 can include an optional unwrapping element 96. The unwrapping element 96 is understood to resolve any spatial aliasing in the delay signal 60. In one embodiment the delay estimator 28 includes an unwrapping element 96 that can generates the delay signal 60, $\tau_{ij}$, in three iterations, each of which generates an increasingly accurate estimate of the time delay between the signals. The accuracy of the delay estimate is understood to depend upon the limits of summation in the above equation. In general, the delay estimate tends to converge upon the true delay more precisely as the number of terms in the summation is increased. Therefore, it is preferred to sum over k=0, 1, . . . , $k_{max}$ where $k_{max}$ corresponds to the highest frequency of interest. For speech, a reasonable cutoff can be 5.4 kHz with $$k_{max}=\left\lfloor \frac{5400 * N}{f_{rate}} \right\rfloor .$$

However, the 2 πm phase ambiguity in the delay signal 60 can restrict the region in which the phase angle difference signal 62 is understood to vary in a linear fashion and therefore limits the upperbound limit of the summation index. One preferred unwrapping element 96 generates a delay signal 60 by providing two initial estimates of the delay signal 60.

The unwrapping element 96 can generate an initial estimate for the delay signal 60, $\tau_{ij1}$, by deterring a first frequency range over which spatial aliasing is understood not to occur. The first range, K, is determined by:

$$K = K_{ij1} = \min \left\{ \left\lfloor \frac{c * N}{2 * |m_j - m_i| * f_{rate}} \right\rfloor , k_{max} \right\}$$

where c is the propagation speed of the input signals, and $|m_j-m_i|$ represents the spatial distance between the microphones 16. The minimum of the two solutions can be used for K.

The unwrapping element 96 can generate a second estimate of the delay signal 60 by computing the delay signal 60 over the range determined by:

$$K = K_{ij2} = \min \left\{ \left\lfloor \frac{N}{2(|\tau_{ij1}| + \epsilon} \right\rfloor , k_{max} \right\}$$

The error term, ϵ, can be included in the above expression to compensate for the inaccuracy of the initial estimate of the delay signal 60, $t_{ij1}$. Nominal values for ϵ range from 0.5 to 2 samples, depending on the expected accuracy of the initial estimate.

In a third iteration, the unwrapping element 96 uses the second estimate of the delay signal 60, $\tau_{ij2}$, to unwrap the phase angle difference signal 62, $d_{ij}(k)$, and then a final estimate for the delay signal 60 can be computed over the entire frequency range of interest ($K=K_{max}$). The phase angle differences in signal 62 should vary linearly in frequency with variations in linearity due to additive noise in the sensor signal. The delay estimator 58 can examine the phase angle differences as a function of frequency, and given the second estimate of the delay signal 60, unwrap the phase differences that evidence a 2πm phase ambiguity. It is preferred that the unwrapping depend upon an accurate estimate of $\pi_{ij}$, which is typically not available until the end of the second iteration.

Figure 4A:
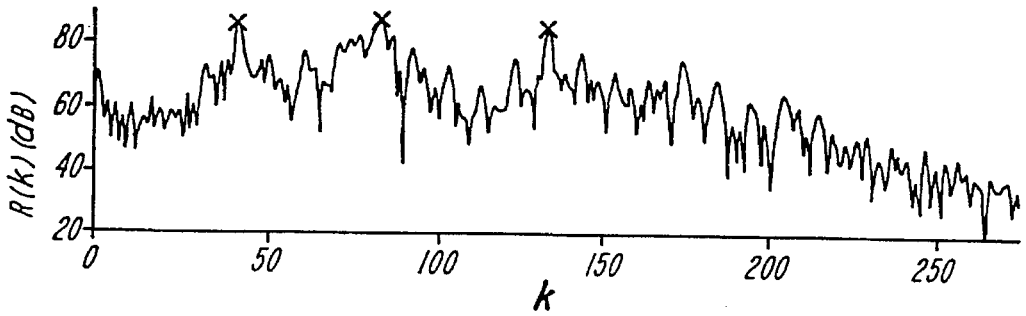
FIG. 4 illustrates the operation of a delay estimator that includes an unwrapping element for limiting spatial aliasing.
Figure 4B:
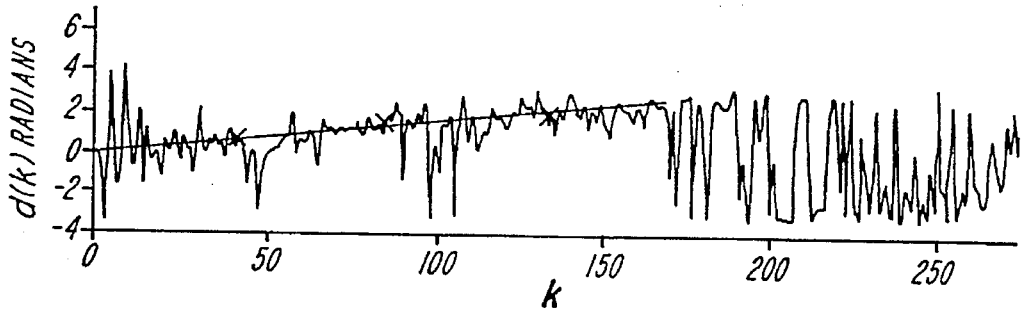
Figure 4C:
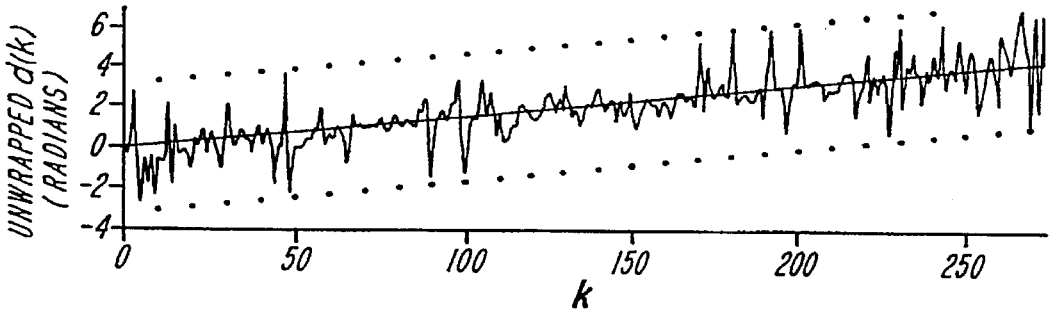

The iterative procedure of the unwrapping element 96 is illustrated in FIG. 4. The upper graph is a plot of spectral magnitudes in dB for the frequency-dependent signal, the middle graph displays the original phase angle difference signal 62 used for the first two iterations, and the bottom graph is the unwrapped phase angle difference signal 62 applied in the final iteration of the algorithm. In each case, the horizontal axis is the first 275 points of the DFT, corresponding to 0 through 5.4 kHz. In the initial stage, $K_{ij1}=53$, which when used as the upper bound of the summations for the initial estimate of delay signal 60, and generates a time delay in samples of $\tau_{ij1}=1.513$ samples. This estimate of the delay signal 60 is then used to calculate the range of summation for the second iteration. Using an error term ϵ=1.5 samples, $K_{ij2}=169$ and the second delay estimate for signal 60 is found to be $\tau_{ij2}=2.579$ samples. The delay signal 60 may be viewed as the slope of the line that fits these points in a weighted mean squared sense. In the second graph, the phase wrapping ambiguity is apparent and the graph does not appear to be linear. In the third iteration, the phase differences in the signal 62 are unwrapped by the unwrapping element 96 and plotted on the lower graph. The unwrapping algorithm places each phase angle difference within π radians of the slope line by adding/subtracting integer multiples of 2π. The dotted lines in the lower graph represent the boundaries of the unwrapping algorithm. The final delay signal 60, $\tau_{ij}$, is then calculated with the unwrapped phase angle difference signal 62, $d_{ij}(k)$ , over the entire frequency range (k=0,1, . . . , $k_{max}$).

The frequency-domain delay estimator has several advantages over its time-domain counterpart. It is computationally simple, does not necessitate the use of search methods, and has precision independent of sampling rate.

With reference again to FIG. 1, a further embodiment of the present invention, that includes an error detection element 100 can be described. The delay estimator 28 of FIG. 1 includes an optional error detection unit 100 that is in electrical circuit the weighting element 32. The error detection unit 100 can generate an error signal 102 that represents the accuracy of the delay signal 60 generated by the phase difference estimator 28. In one preferred embodiment of the invention, the weighting element 32 can affect the weighting of the aligned output signal 64 responsive to the error signal 102. The weighting element 32 can include a user-selected error parameter. The weighting element 32 can compare the generated error signal 102 with the user-selected error parameter and generate a weighting parameter for the associated output signal 64 as a function of the error signal 102 and the user-selected error parameter.

In one preferred embodiment of the error detection unit 100, the detection unit 100 includes a data processor that generates the error signal 102 as a function of the phase angle difference signal 62 and the magnitude components of the frequency dependent signal. In one example the error signal 102 is computed from:

$$\mathrm{Error}_{Norm}(\tau_{ij}) = \frac{\sum_{k=0}^{K} |R(k)|^2 \left( \left( \frac{2\pi k}{N} \right) \tau_{ij} - d_{ij}(k) \right)^2}{\sum_{k=0}^{K} |R(k)|^2}$$

The error signal 102 can provide a useful means for evaluating the significance of a delay signal 60. A relatively large error signal 102 can indicate that the predicted delay signal 60 is inaccurate, as would be expected during times when there are no input signals in-coming to the sensor array 12. A small value can demonstrate that the delay signal 62 is a good measure of the relative time delay between the sensors 16.

In one embodiment, a normalized version of this error signal 102 can be calculated and compared to a user-selected parameter that represents an environmentally dependent threshold to determine if the delay signal 60 is valid. Environmentally dependent factors can include background noise, deviations between sensor performance and other similar factors.

In another preferred embodiment, the error detection unit 100 generates a signal that represents the geometric mean of the individual magnitudes of the frequency-dependent signals, $|R(k)|=\sqrt{|R_i(k)||R_j(k)|}$, and uses this mean to compute the error signal 102. This preferred embodiment is understood to be more resistant to noise and gain differences between the sensors 16.

Figure 5:
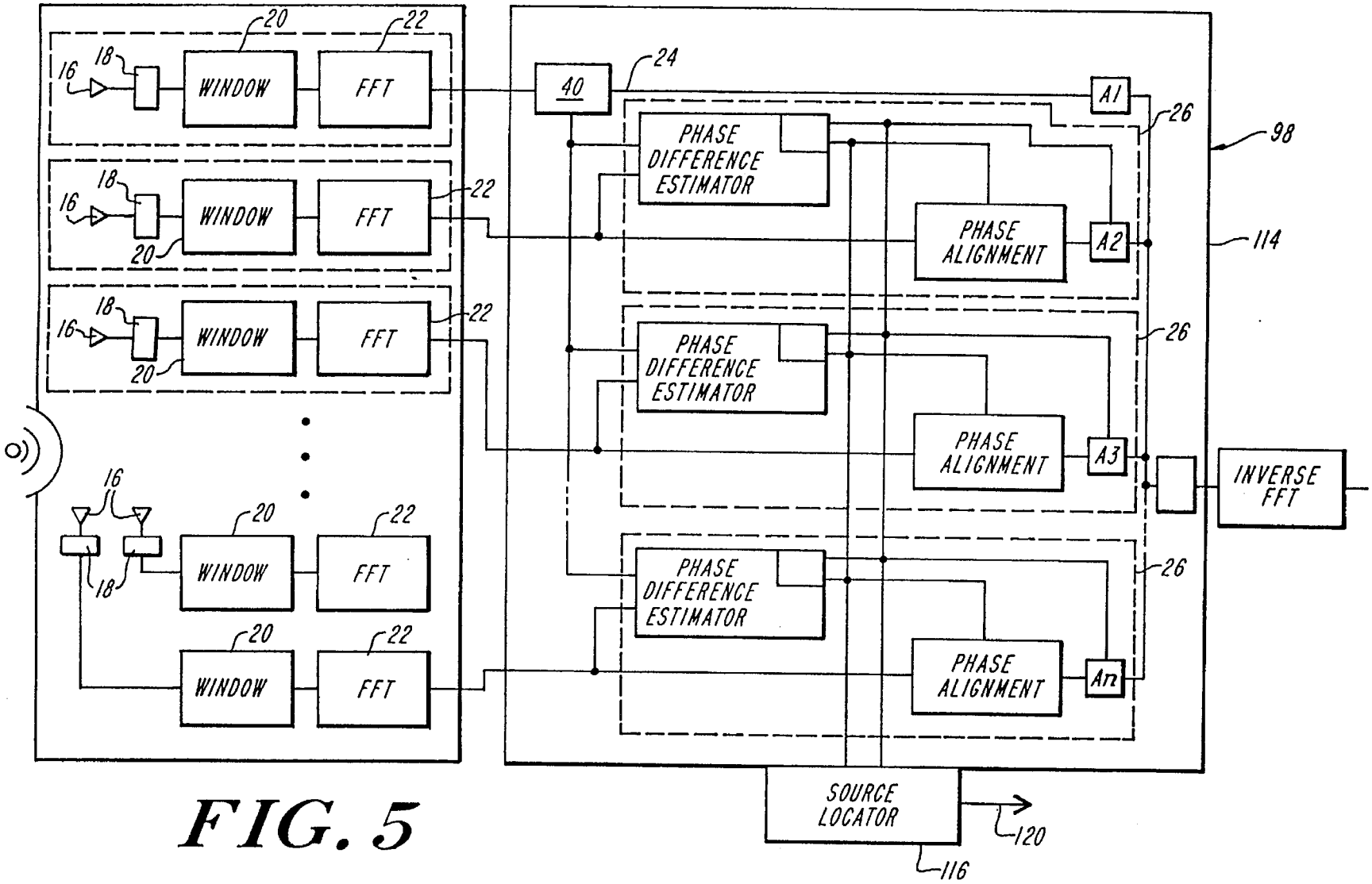
FIG. 5 illustrates a further embodiment of the present invention that includes an orthogonal array of sensor elements.

In a further embodiment of the present invention, depicted in FIG. 5, a beamforming apparatus 98 according to the invention can be constructed having an orthogonal array 90 of sensor elements 16. The beamforming apparatus 98 according to this embodiment of the invention determines the position of target source 38 through a series of triangulation calculations which require knowledge of the signal's relative delay when projecting onto a pair of microphone receivers.

The beamforming apparatus 98 can include the orthogonal array 90, and a signal processor 114. The orthogonal array 90 can include a plurality of sensor elements 16 each connected to an input channel that includes a sampling unit 18, a window filter 20 and a time-to-frequency transform element 22. The signal processor 114 can include a reference channel 24 and plural alignment channels 26. Each alignment channel 26 includes a phase difference estimator 28, phase alignment element 30 and an optional weighting element 32. The signal processor 114 can further include a source locator unit 116, in electrical circuit with each of the phase difference estimators 28, a summation element 34 in electrical circuit with each of the phase alignment elements 30 and a frequency-to-time transform element 36 in electrical circuit with the summation element 34. As will be explained in greater detail hereinafter, the source locator unit 116 generates an output signal 120 that represents the location of the detected source, e.g., source 38, relative to the sensor array 90.

Figure 6:
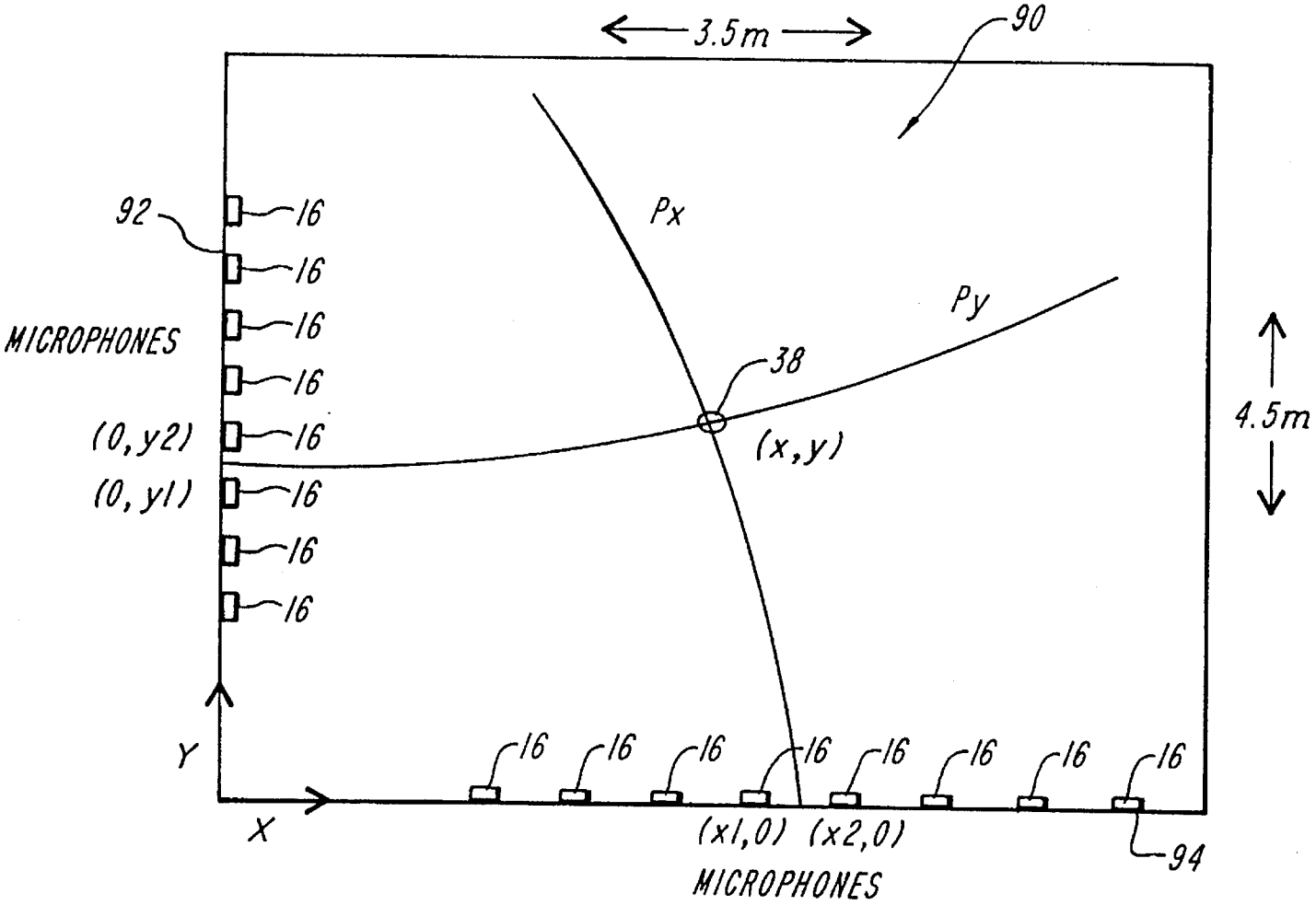
FIG. 6 illustrates in more detail the orthogonal array of FIG. 1.

FIG. 6 illustrates the orthogonal array 90 that includes sensor elements 16 distributed in two independent arrays including a horizontal array 94 and a vertical array 92. An orthogonal array is preferred for its stability in evaluating both the x and y positions although other transverse array configurations can be practiced with the present invention. Further, it should be apparent to one of ordinary skill in the art of signal processing that the array 90 can include third array of sensors 16 disposed above or below the plane formed by the orthogonally arranged arrays 92 and 94. The third array can configured into the system in the manner of arrays 92 and 94 and can yield time delay information, related to a third dimension, or coordinate of the source 38, for example height.

While either linear array 92 or 94 may be used to evaluate both the x and y coordinates of the source position, the triangulation procedure is understood to be most effective if position coordinates are determined by the array in the direction normal to the source. For example, using only the sensors 16 in the array 94 is effective for evaluating the x-coordinate of the source location 38, but not as accurate at finding the y-coordinate. By combining both axes in the triangulation procedure, the estimate is equally sensitive in either direction.

Each sensor 16 detects signals, including signals generated from the target source 38, and generates an electrical response signal that includes a component that represents the signal generated from the signal source 38. The sensors 16 sensor array 90 can be microphones, antennas, sonar phones or any other sensor capable of detecting a propagating signal and generating an electrical response signal that represents the detected signal.

The source locator 116 can generate the position signal 120 that represents the position of the source 38 relative to the sensor array 90. In one preferred embodiment of the source locator 116, at least four phase difference estimators 28 transmit delay signals 60 to the source locator 116. Preferably the delay signals 60 transmitted to the source locator 116 represent the time delay between two spatially adjacent sensors 16 in array 94 and two spatially adjacent sensors 16 in array 92. With reference to FIG. 6, the generation of position signal 120 can be explained. Given four sensors 16, one pair on the x-axis array 92 at positions x1 and x2 and another pair on the y-axis array 94 at y1 and y2, the curves Px and Py represent the loci of points $px \epsilon Px$ and $py \epsilon Py$ such that:

$$|px - x2| - |px - x1| = \delta_x$$
$$|py - y2| - |py - y1| = \delta_y$$

where $\delta_x$ and $\delta_y$ are constants such at $|\delta_x| \leqq |x2-x1|$ and $|\delta_y| \leqq y2-y1|$. The curve Px can be interpreted as the set of locations which produce the same relative delay between x1 and x2. This relative delay, represented by the delay signal 60, $\tau_x$ (in samples) can be related to $\delta_x$ by the following relation:

$$\delta_x = \frac{\tau_x * c}{f_{rate}}$$

Where $f_{rate}$ is the sampling rate of the sampling elements 18. Py and $\delta_y$ may be regarded similarly with respect to the sensors 16 on the y-axis array 94.

The intersection of Px and Py represents a unique source location that produces relative delay signals 60, $\tau_x$ and $\tau_y$, between the respective sensor 16 pairs. The source locator unit 116 can generate the position signal 120 by estimating the relative delays at each sensor pair, and generating the curves Px and Py and find their intersection. Given that Px and Py represent one half of the hyperbolas, the intersection of Px and Py may be solved for algebraically. The simultaneous solution of the hyperbola equations reduces to finding the roots of a fourth order polynomial. From these four roots, the real root which corresponds to the actual coordinate pair (x,y) of the source location can be identified. This is can be accomplished by noting that the four intersection points of these two hyperbolas are each located in a distinct quadrant of the x-y plane. These four quadrants are demarcated by the lines y=(y1+y2)/2 and x=(x1+x2)/2. The proper quadrant may be chosen directly from the signs of the $\delta_x$ and $\delta_y$ terms.

In one preferred embodiment of the source locator 116, the locator 116 can select which sensor pairs and delay signals 60 to use to generate the position signal 120. For eight sensors 16 there are 28 subsets of two which corresponds to $28^2$=784 combinations of the x-y axes sensor pairs. The first restriction imposed is to consider only pairs of sensors 16 that are spatially contiguous. The second constraint is to consider only those delay signals 60 with an associated normalized error less than a certain threshold. The error signal 102 of each error unit 100 can be transmitted by a conducting element to the source locator 116. The source locator can compare the error signal 102 against a user-selected error parameter. If the comparison indicates a large error, then that indicates that the delay signal 60 is either inaccurate, the single source model does not apply, or this is a region of silence. In the first two cases the position signal 120 generated by the source locator 116 is a low quality estimate of the position. In the final case the position signal is meaningless as a position signal 120 but does indicate the presence of a signal source 38.

In the preferred embodiment, the source locator 116 connects to each delay estimator 28 and, for each array 92 and 94, collects the delay signals 60 and corresponding error signal 102 for each set of sensor pairs with less than a user-selected error-threshold. The source locator 116 orders each set by increasing normalized error as represented by the error signal 102. If either set is empty then no position signal 120 is generated. If either set has sensor pairs with error signals 102 below the user-selected error parameter, then the source locator 116 generates a position signal for a user-selected number of sensor pairs. The position signal 120 can be generated as the mean of several position estimates.

The source locator unit 116 can be a conventional electrical circuit card that includes arithmetic and logic circuits for generating from delay signals 60 of the phase difference estimators 28, a position signal that represents the position of the source 38 relative to the sensor array 90. The source locator unit 116 can also be a conventional data processor, such as a engineering workstation of the type sold by the SUN Corporation, having an application program for generating from the delay signals 60 of the phase difference estimators 28, a position signal that represents the position of the source 38 relative to the sensor array 90.

Described above are improved methods and apparatus for combining a plurality of signals to generate a beam signal for enhancing the reception of signals at a select position relative to an array of sensor elements. The invention has been described with reference to preferred, but optional, embodiments of the invention that achieve the objects of the invention set forth above.

Thus, for example, a steerable array of microphones has been described that has the potential to replace the traditional microphone as the input transducer system of speech data. An array of microphones has a number of advantages over a single-microphone system. It may be electronically aimed to provide a high-quality signal from a desired source location while it simultaneously attenuates interfering talkers and ambient noise. In this regard, an array has the ability to outperform a single, highly-directional microphone. An array system does not necessitate local placement of transducers, will not encumber the talker with a hand-held or head-mounted microphone, and does not require physical movement to alter its direction of reception. These features make it advantageous in settings involving multiple or moving sources. Furthermore, it is capable of activities that a single microphone cannot perform, namely the automatic detection, location, and tracking of active talkers in its reception region. Existing array systems have been used in a number of applications. These include teleconferencing, speech recognition, speech acquisition in an automobile environment, large-room recording-conferencing, and hearing aid devices. These systems also have the potential to be beneficial in several of other environments, the performing arts and sporting communities, for instance.

The above described embodiments have been set forth to describe more completely and concretely the present invention, and are not to be construed as limiting the invention. Thus, for example, the invention can be practiced as a radar system having two dimensional array of antenna elements disposed at non-uniform spacing in an plane. The array can couple to a signal processor constructed according to the present invention, that can align each of the signals received by the antenna relative to each other. Additionally, the radar system can include a source locator unit that determines from the relative time delays between the antennas the position of the source relative to the antenna array.

It is further intended that all matter and the description and drawings be interpreted as illustrative and not in a limiting sense. That is, while various embodiments of the invention have been described in detail, other alterations which will be apparent to those skilled in the art are intended to be embraced within the spirit and scope of the invention.

In view of the foregoing, what is claimed is:

1. Signal processing apparatus for combining a plurality of frequency-dependent signals wherein each frequency-dependent signal has a magnitude component and a phase angle component, said apparatus comprising reference means for defining one of said frequency-dependent signals as a reference signal having a user-selected phase angle, a plurality of alignment means, each coupled to a respective one of said frequency-dependent signals, for adjusting the phase angles of said signals relative to said reference signal, said alignment means having phase difference estimator means for generating a delay signal representative of a time delay between said reference signal and said frequency-dependent signal, and phase alignment means for generating, as a function of said delay signal, an output signal having a magnitude component representative of the magnitude component of said frequency-dependent signal and having a phase angle component adjusted to a select phase relationship with said reference signal, and summation means, coupled to said plurality of alignment means for summing together said phase aligned output signals to generate a beam signal.

2. Apparatus according to claim 1 further comprising means for generating said plurality of frequency-dependent signals, said means including an array of spatially distributed sensor elements, wherein each sensor element includes means for detecting a signal and generating a respective one of said plural frequency-dependent signals to represent said signal detected at said spatially distributed sensor element.

3. Apparatus according to claim 2 wherein said array includes a linear array of spatially distributed sensor elements.

4. Apparatus according to claim 2 wherein said array includes a two-dimensional array of spatially distributed sensor elements.

5. Apparatus according to claim 2 wherein said array includes a three-dimensional array of spatially distributed sensor elements.

6. Apparatus according to claim 1 wherein said phase difference estimator means includes means for generating said delay signal as a function of said reference signal and said respective one of said frequency-dependent signal.

7. Apparatus according to claim 1 wherein said phase difference estimator means couples to a delay signal of a second alignment means and includes summing means for summing said delay signals to generate a signal representative of the time delay between said respective one of said frequency-dependent signal and said reference signal.

8. A signal processing apparatus according to claim 1 further comprising weighting means, connected to one or more phase alignment means, for increasing or decreasing the magnitude component of each of said output signals.

9. A signal processing apparatus according to claim 1 further comprising weighted averaging means, connected to at least a portion of said phase alignment means, for increasing or decreasing the magnitude component of said output signals as a function of a normalizing factor representative of the number of output signals summed together.

10. Signal processing apparatus for combining a plurality of frequency-dependent signals wherein each frequency-dependent signal has a magnitude component and a frequency component, said apparatus comprising reference means for defining one of said frequency-dependent signals as a reference signal having a user-selected phase angle, a plurality of alignment means, each coupled to a respective one of said frequency-dependent signals, for adjusting the phase angles of said frequency-dependent signals relative to said reference signal, said alignment means having storage means for storing a magnitude component and a phase angle component of said frequency-dependent signal, delay estimator means for generating, as a function of the difference in phase angles of two frequency-dependent signals, a delay signal representative of a time delay between said reference signal and said frequency-dependent signal, and phase alignment means for generating as a function of said delay signal, an output signal having a magnitude component representative of the magnitude component of said frequency-dependent signal and having a phase angle adjusted to a select phase relationship with said reference signal, and summation means, coupled to said plurality of alignment means and having means for summing frequency-dependent signals, for generating a beam signal representative of a summation of said output signals.

11. A signal processing apparatus according to claim 10 wherein said delay estimator includes weighting means for generating as a function of said magnitude components of said frequency-dependent signal, said difference in phase angles.

12. A signal processing apparatus according to claim 10 further including error detection means for generating, as a function of said delay signal and said phase angle component of said frequency-dependent signal, an error signal representative of the accuracy of said delay signal.

13. A signal processing apparatus according to claim 12 wherein said summation means includes means for monitoring said error signal to adjust said beam signal responsive to an error signal larger than a user-selected error-parameter.

14. A signal processing apparatus according to claim 12 further comprising means for generating said error signal as a function of the geometric mean of the magnitude components of two frequency-dependent signals.

15. A beamforming apparatus for combining a plurality of frequency-dependent signals wherein each frequency-dependent signal has a magnitude component and a phase angle component comprising means for generating said plurality of frequency-dependent signals, having an array of spatially distributed sensor elements, wherein each sensor element includes transducer means for detecting a signal and for generating a respective one of said plural signals to represent said signal detected at said spatially distributed sensor element, reference means for storing one of said frequency-dependent signals as a reference signal having a user-selected phase angle, a plurality of alignment means, each coupled to a respective one of said frequency-dependent signals, for adjusting the phase angle components of said frequency-dependent signals relative to said reference signal, said alignment means having storage means for storing said magnitude component and said phase angle component of said frequency-dependent signal, delay estimator means for generating, as a function of the difference in phase angles of two frequency-dependent signals, a delay signal representative of a time delay between said reference signal and said frequency-dependent signal, and phase alignment means for generating as a function of said delay signal, an output signal having a magnitude component representative of the magnitude component of said frequency-dependent signal and having a phase angle component adjusted to a select phase relationship with said reference signal, and summation means, coupled to said plurality of alignment means and having means for summing frequency-dependent signals, for generating a beam signal representative of a combination of said output signals.

16. Apparatus according to claim 15 wherein said array includes a linear array of spatially distributed sensor elements and said detection means includes means for detecting audio signals.

17. Apparatus according to claim 15 wherein said array includes a linear array of spatially distributed microphones of the type amenable for detecting audio signals.

18. Apparatus according to claim 15 wherein said array includes digital conversion means, coupled to each of said sensor elements, for generating said respective signal as digital electrical signal.

19. Apparatus according to claim 18 wherein said array includes window filter means, coupled to each of said sensor elements, for generating said respective signal to represent a discrete portion of said digital electrical signal.

20. Apparatus according to claim 18 wherein said array includes a 512 point hanning window filter means, coupled to each of said sensor elements, for generating said respective signal to represent a 512 point portion of said digital electrical signal.

21. Apparatus according to claim 15 wherein said array further comprises time-to-frequency transform means, coupled to each of said sensor elements, for generating said respective signal as a frequency-dependent representation of said detected signal.

22. Apparatus according to claim 21 wherein said frequency transform means includes fast fourier transform means for generating a plurality of fourier coefficients representative of at least a portion of the spectral content of said detected signal.

23. Apparatus according to claim 15 wherein said delay estimator further comprises spatial aliasing filter means for generating said delay signal as a function of the spatial distribution of said sensor elements.

24. Apparatus according to claim 15 where in said summation means further comprises frequency-to-time transform means, coupled to said signal summation means, for generating said beam signal as a time-dependent signal.

25. Apparatus according to claim 15 wherein said array of spatially distributed sensor elements has a first array of sensor elements spatially distributed relative to a first axis and a second array of sensor elements spatially distributed relative to a second axis extending transversely to said first axis, said reference means has means for storing a first reference signal and a second reference signal representative of frequency magnitudes and phase angles of one of said frequency-dependent signals generated by said first array and said second array respectively, and said delay estimator means has means for generating, a first delay signal and a second delay signal representative of the time delay between said first reference signal and a frequency-dependent signal generated by said first array and said second reference signal and a frequency-dependent signal generated by said second array, and means for generating a position signal, as a function of said first delay signal and said second delay signal, representative of the position of said detected signal relative to said first and second arrays.

* * * * *